US007718910B2

(12) United States Patent
Tatehata et al.

(10) Patent No.: US 7,718,910 B2
(45) Date of Patent: May 18, 2010

(54) MOVABLE CONTACT ASSEMBLY AND SWITCH USING THE SAME

(75) Inventors: Naoki Tatehata, Kyoto (JP); Takefumi Inoue, Nara (JP)

(73) Assignee: Panasonic Corporation, Osaka (JP)

( * ) Notice: Subject to any disclaimer, the term of this patent is extended or adjusted under 35 U.S.C. 154(b) by 15 days.

(21) Appl. No.: 12/140,514

(22) Filed: Jun. 17, 2008

(65) Prior Publication Data

US 2008/0314722 A1 Dec. 25, 2008

(30) Foreign Application Priority Data

Jun. 20, 2007 (JP) ..... 2007-162075
Nov. 1, 2007 (JP) ..... 2007-284981

(51) Int. Cl.
*H01H 9/00* (2006.01)

(52) U.S. Cl. ..... 200/314; 200/310

(58) Field of Classification Search ..... 200/314
See application file for complete search history.

(56) References Cited

U.S. PATENT DOCUMENTS 5,950,808 A * 9/1999 Tanabe et al. ..... 200/314
7,015,408 B2 * 3/2006 Hirahata et al. ..... 200/310
7,340,273 B2 * 3/2008 Ono ..... 455/550.1
2006/0260922 A1 * 11/2006 Lee et al. ..... 200/314
2007/0039809 A1 * 2/2007 Aihara et al. ..... 200/310

FOREIGN PATENT DOCUMENTS

JP 2007-053063 A 3/2007

* cited by examiner

*Primary Examiner*—Michael A Friedhofer
*Assistant Examiner*—Lheiren Mae A Caroc
(74) *Attorney, Agent, or Firm*—RatnerPrestia

(57) ABSTRACT

A movable contact assembly includes a movable contact having a dome shape, a base sheet contacting an upper surface of the movable contact, a columnar portion provided on an upper surface of the base sheet, and a light guide sheet provided on an upper surface of the columnar portion. The light guide sheet has a light-receiving surface for introducing light into the light guide sheet, and allows the introduced light to be emitted from an upper surface of the light guide sheet. The base sheet includes a dome portion having a concave lower surface, and a flat portion connected with an outer edge of the dome portion. The columnar portion is positioned on the upper surface of the dome portion away from the outer edge of the dome portion of the base sheet. This movable contact assembly provides a switch illuminating its upper surface and being activated easily with a preferable feeling.

13 Claims, 3 Drawing Sheets

MOVABLE CONTACT ASSEMBLY AND SWITCH USING THE SAME

FIELD OF THE INVENTION

The present invention relates to a movable contact assembly for configuring an input operation unit for various electronic apparatuses, and a switch including the movable contact assembly.

BACKGROUND OF THE INVENTION

Key switches having illuminating functions are often used in operating panels mounted to various electronic apparatuses, such as portable telephones and portable data terminals. Such illuminating functions are performed by directly illuminating keys with a light-emitting diode (LED) or by transmitting light from an LED through a light guide sheet.

FIG. 4 is a sectional view of switch 501 disclosed in Japanese Laid-Open Patent Publication No. 2007-53063. Central fixed contact 101 and peripheral fixed contact 102 are provided on an upper surface of circuit board 100. Sheet 110 is attached to the upper surface of circuit board 100 with adhesive layer 111. Sheet 110 has dome portion 120 protruding upwardly. Movable contact 130 having a dome shape is accommodated in dome portion 120. A lower surface of the central portion of movable contact 130 faces central fixed contact 101 with a gap between contacts 101 and 130. An outer edge of movable contact 130 is mounted onto peripheral fixed contact 102. An upper surface of movable contact 130 is held on dome portion 120 of sheet 110 with adhesive layer 111.

Sheet 110 is a light guide sheet that transmits light incident from a side edge surface, and illuminates the upper surface.

Light source 150 is mounted on circuit board 100. Light source 150 includes light-emitting portion 151 facing the side edge surface of sheet 110 to cause light from light source 150 to enter in parallel with sheet 110 made of a light guide sheet. Transparent resin 160 collects light from light-emitting portion 151, and introduces the light efficiently onto the side edge surface of sheet 110.

An operation of conventional switch 501 will be described below.

As a pressing force is applied to movable contact 130 from above dome portion 120 of sheet 110, the force reverses the dome shape of movable contact 130 when the force exceeds a predetermined level. Then, movable contact 130 contacts central fixed contact 101, thereby connecting central fixed contact 101 electrically with peripheral fixed contact 102. And, when the force is released, movable contact 130 returns to have its original dome shape shown in FIG. 4, thereby electrically disconnecting central fixed contact 101 from peripheral fixed contact 102.

When light source 150 emits light, the light enters through the side edge surface of sheet 110, the light guide sheet. The light is introduced into sheet 110 including dome portion 120, and illuminates the upper surface of sheet 110. Dome portion 120 covers movable contact 130 along the upper surface of movable contact 130. A key made of light-transmissible material and having a mark, such as characters or symbols, may be provided on sheet 110. This structure provides switch 501 which is operated easily even in the dark, in which the key is activated, and the mark is visibly recognized.

In switch 501, sheet 110, the light guide sheet, has a shape along the dome shape of movable contact 130. The light guide sheet having the light entering the side edge surface thereof may preferably thick so as to accept the light easily. For example, the sheet may often have a thickness of about 0.2 mm. However, if sheet 110, the light guide sheet, has the thickness of 0.2 mm, an excessive force is required due to a stress of sheet 110 when depressing movable contact 130, accordingly preventing switch 501 from being activated easily.

SUMMARY OF THE INVENTION

A movable contact assembly includes a movable contact having a dome shape, a base sheet contacting an upper surface of the movable contact, a columnar portion provided on an upper surface of the base sheet, and a light guide sheet provided on an upper surface of the columnar portion. The light guide sheet has a light-receiving surface for introducing light into the light guide sheet, and allows the introduced light to be emitted from an upper surface of the light guide sheet. The base sheet includes a dome portion having a concave lower surface, and a flat portion connected with an outer edge of the dome portion. The columnar portion is positioned on the upper surface of the dome portion away from the outer edge of the dome portion of the base sheet.

This movable contact assembly provides a switch illuminating its upper surface and being activated easily with a preferable feeling.

DESCRIPTION OF THE PREFERRED EMBODIMENT

Figure 1A:
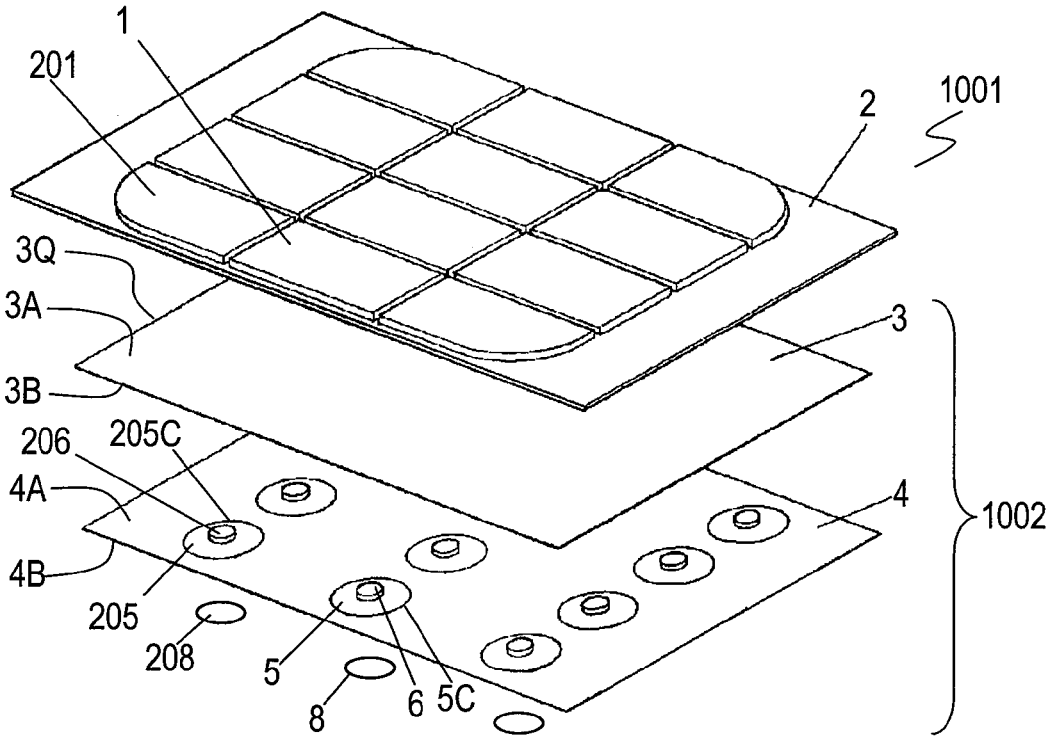
FIG. 1A is an exploded perspective view of a switch according to an exemplary embodiment of the present invention.

FIG. 1A is an exploded perspective view of switch 1001 according to an exemplary embodiment of the present invention. Plural keys 1 and 201 made of resin, such as polycarbonate, are provided on a primary surface of switch 1001. Key sheet 2 made of elastic material, such as silicone rubber, is provided under key 1. Keys 1 and 201 are adhered to key sheet 2 with an adhesive. Keys 1 and 201 and key sheet 2 may be made of the same material and may be formed unitarily with each other.

Lower surface 2B of key sheet 2 is flat. Upper surface 3A of light guide sheet 3 is situated on lower surface 2B. Upper surface 3A of light guide sheet 3 may be adhered to lower surface 2B of key sheet 2 or may simply contact lower surface 2B. Light source 51, such as a light-emitting diode, is coupled to edge surface 3P of light guide sheet 3. Edge surface 3P has light-receiving surface 3Q for introducing light from light source 51 into light guide sheet 3.

Light guide sheet 3 is made of transparent film made of material, such as acrylic resin, silicone resin, urethane resin, polycarbonate resin, or polyethylene terephthalate (PET) resin, having high light conductivity.

Figure 1B:
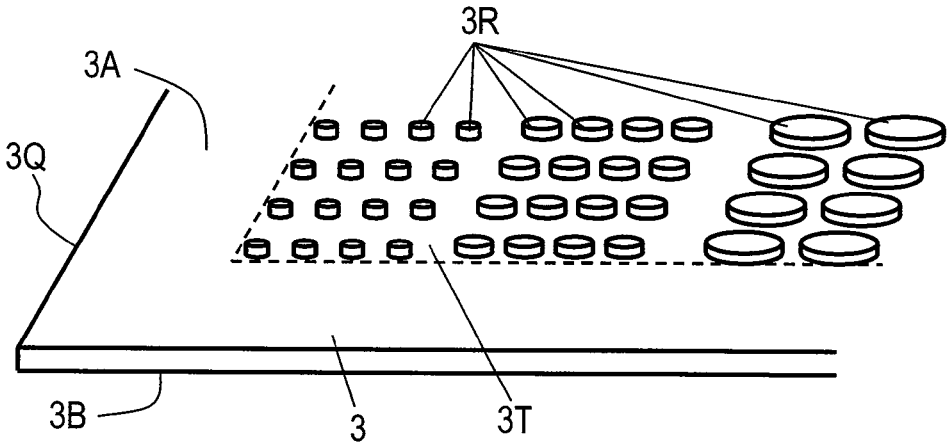
FIG. 1B is an enlarged view of a light guide sheet of the switch according to the embodiment.

FIG. 1B is an enlarged view of light guide sheet 3. Portion 3T of upper surface 3A of light guide sheet 3 is a rough surface that scatters light entering from the light-receiving surface 3Q and that efficiently emits the light from portion 3T of the rough surface out of upper surface 3A. The rough surface of portion 3T of upper surface 3A, the rough surface, may be formed, by, for example, screen-printing, a lot of dots 3R made of transparent resin. In this case, the brightness of upper surface 3A of light guide sheet 3 changes depending on the distance from light-receiving surface 3Q. However, the brightness of upper surface 3A can be substantially uniform by determining the diameters and density of dots 3R appropriately. The light transmitting inside light guide sheet 3 scatters to illuminate keys 1 and 201 provided on upper surface 3A.

Figure 2:
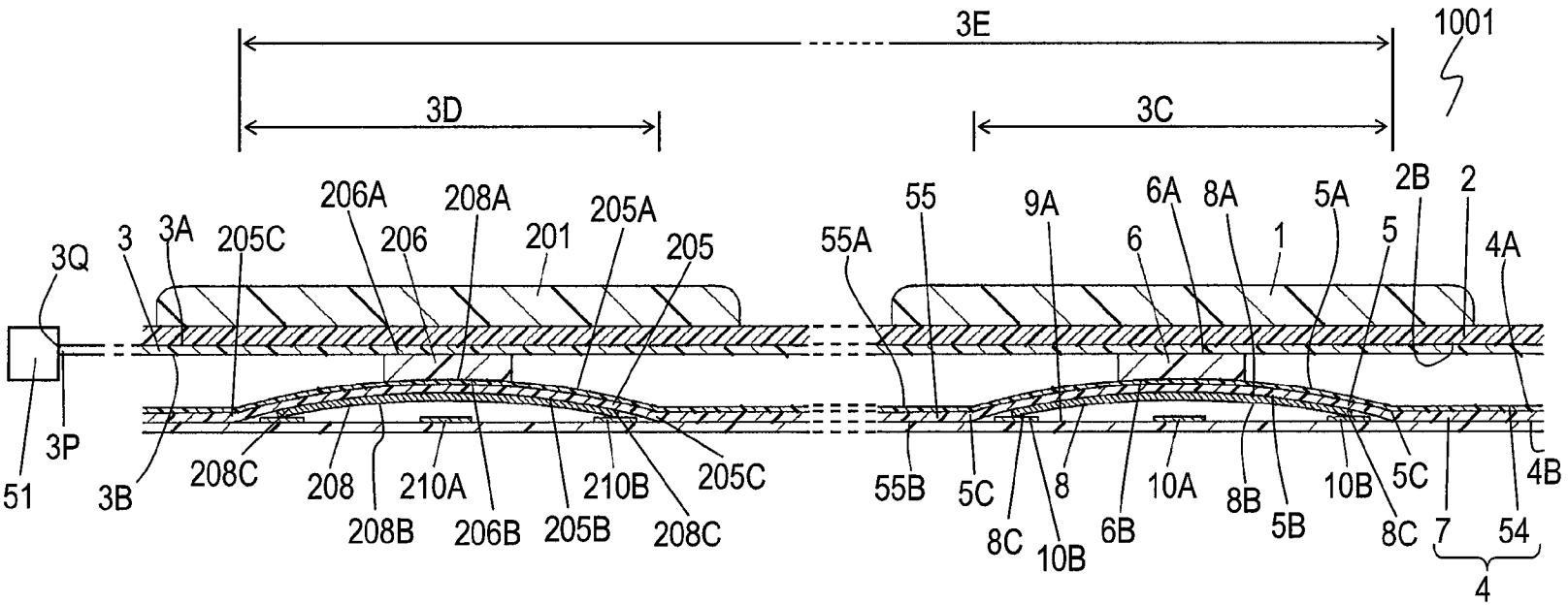
FIG. 2 is a sectional view of the switch according to the embodiment.

FIG. 2 is a sectional view of switch 1001. Base sheet 4 made of an insulating sheet is provided under light guide sheet 3. Base sheet 4 includes base layer 54 situated on upper surface 4A and adhesive layer 7 situated on lower surface 4B. Movable contacts 8 and 208 are bonded to lower surface 4B of base sheet 4 with adhesive layer 7. Movable contacts 8 and 208 made of thin metal sheets have circular or elliptical outer edges 8C and 208C, respectively. Movable contact 8 protruding upward has a dome shape having convex upper surface 8A and concave lower surface 8B. Movable contact 208 protruding upward has a dome shape having convex upper surface 208A and concave lower surface 208B. Base sheet 4 includes dome portions 5 and 205 contacting movable contacts 8 and 208, respectively, and flat portion 55 provided between dome portions 5 and 205. Dome portions 5 and 205 have concave lower surfaces 5B and 205B along convex upper surfaces 8A and 206A of movable contacts 8 and 208, respectively. Dome portions 5 and 205 have upper surfaces 5A and 205A and outer edges 5C and 205C, respectively. Flat portion 55 is connected with outer edges 5C and 205C of dome portions 5 and 205, and has upper surface 55A and flat lower surface 55B. That is, upper surface 4A of base sheet 4 includes upper surfaces 5A and 205A of dome portions 5 and 205. Lower surface 4B includes lower surfaces 5B and 205B of dome portions 5 and 205 and lower surface 55B of flat portion 55. Base sheet 4 having such configuration may be formed by embossing an insulating sheet.

Figure 3:
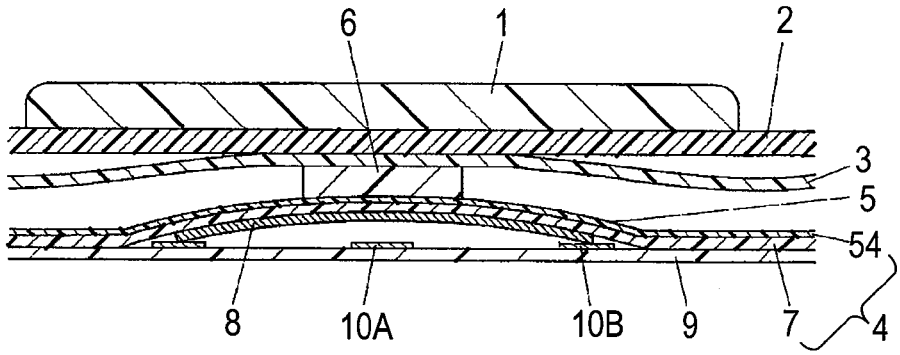
FIG. 3 is a sectional view of the switch according to the embodiment.

Columnar portions 6 and 206 having substantially circular columnar shapes are provided on upper surfaces 5A and 205A of dome portions 5 and 205 of base sheet 4, respectively. Columnar portion 6 has upper surface 6A and lower surface 6B situated on upper surface 5A away from outer edge 5C of dome portion 5. Columnar portion 206 has upper surface 206A and lower surface 206B situated on upper surface 205A away from outer edge 205C of dome portion 205. Lower surface 6B of columnar portion 6 is adhered to upper surface 5A of dome portion 5. Upper surface 6A of columnar portion 6 is mounted on lower surface 3B of light guide sheet 3. Lower surface 206B of columnar portion 206 is adhered to upper surface 205A of dome portion 205 Upper surface 206A of columnar portion 206 is mounted on upper surface 205A of dome portion 205. Light guide sheet 3 has a plate shape. That is, portions 3C and 3D of light guide sheet 3 located directly above dome portions 5 and 205 of base sheet 4 are flat. At least portion 3E of light guide sheet 3 extending from portion 3C to portion 3D is flat. Light guide sheet 3 is supported with columnar portions 6 and 206 from beneath at portions 3C and 3D. Even before being adhered to lower surface 2B of key sheet 2, light guide sheet 3 is attached to base sheet 4 with columnar portions 6 and 206 while maintaining nearly horizontal orientation. Light guide sheet 3, columnar portions 6 and 206, movable contacts 8 and 208, and base sheet 4 constitute movable contact assembly 1002. As shown in FIG. 3, portions of light guide sheet 3 away from columnar portion 6 (206) may sag, however, it has little or no effect to the operation of the movable contact assembly and the function of the light guide sheet.

Figure 4:
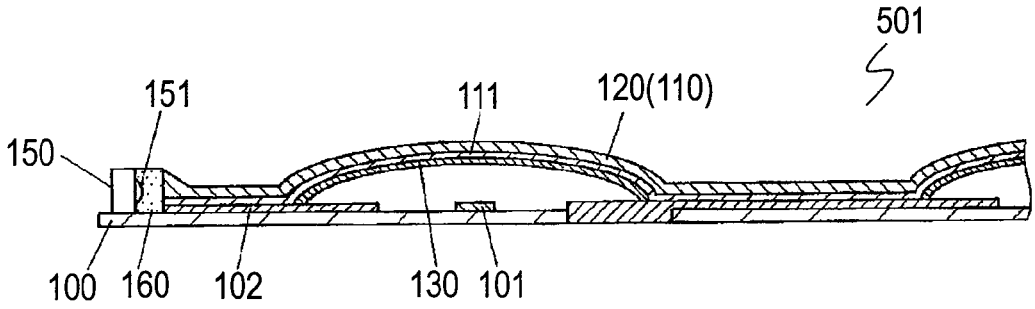
FIG. 4 is a sectional view of a conventional switch.

In movable contact assembly 1002 of switch 1001, light guide sheet 3 is away from base sheet 4 via columnar portions 6 and 206, and allows base sheet 4 to mainly have a function for holding movable contacts 8 and 208, thus allowing base sheet 4 not to guide light. Hence, the thickness of base sheet 4 may be smaller than that of sheet 110 of conventional switch 501 shown in FIG. 4, and may be smaller than 0.2 mm, for example, 0.15 mm or preferably smaller than 0.1 mm.

Movable contact assembly 1002 is assembled with key sheet 2 and board 9. As shown in FIG. 2, movable contact assembly 1002 is bonded to board 9 with adhesive layer 7 provided on lower surface 4B of base sheet 4. Fixed contacts 10A, 10B, 210A, and 210B are provided on upper surface 9A of board 9. Fixed contacts 10A and 210A face lower surfaces 8B and 208B of movable contacts 8 and 20, respectively, by gaps between surfaces 10A and 8B and between 210A and 208A. Fixed contacts 10B and 210B contact outer edges 8C and 208C of movable contacts 8 and 208 mounted thereon.

An operation of switch 1001 will be described below.

Key 1 is pressed to apply a pressing force to key 1, and key sheet 2 having elasticity accordingly sags partially, accordingly causing light guide sheet 3 to sag. Upon light guide sheet 3 sagging, the pressing force is transmitted to movable contact 8 through columnar portion 6. Upon exceeding a predetermined level, the pressing force reverses the dome shape of movable contact 8 to cause upper surface 8A and lower surface 8B to be concave and convex, respectively. This operation allows lower surface 8B of movable contact 8 to contact fixed contact 10A, and connects fixed contact 10A electrically with fixed contact 10B, thus turning on the switch. The pressing force applied to key 1 is released, and key sheet 2 and base sheet 4 accordingly return to have their original shapes by their elastic force. The shape of movable contact 8 returns to its original shape, thus having convex upper surface 8A and concave lower surface 8B. Thereby, lower surface 8B of movable contact 8 is removed from fixed contact 10A, thus disconnecting fixed contact 10A from fixed contact 10B, thus turning off the switch.

Key 201 is pressed to apply a pressing force to key 201, and key sheet 202 having elasticity accordingly sags partially, accordingly causing light guide sheet 3 to sag. Upon light guide sheet 3 sagging, the pressing force is transmitted to movable contact 208 through columnar portion 206. Upon exceeding a predetermined level, the pressing force reverses the dome shape of movable contact 208 to cause upper surface 208A and lower surface 208B to be concave and convex, respectively. This operation allows lower surface 208B of movable contact 208 to contact fixed contact 210A, and connects fixed contact 210A electrically with fixed contact 210B, thus turning on the switch. The pressing force applied to key 201 is released, and key sheet 202 and base sheet 4 accordingly return to have their original shapes by their elastic force. The shape of movable contact 208 returns to its original shape, thus having convex upper surface 208A and concave lower surface 208B. Thereby, lower surface 208B of movable contact 208 is removed from fixed contact 210A, thus disconnecting fixed contact 210A from fixed contact 210B, thus turning off the switch.

Base sheet 4 covers movable contacts 8 and 208, hence greatly influencing the reversing of the shapes of movable contacts 8 and 208 due to their elastic deformation. As described above, in switch 1001 in accordance with the embodiment, base sheet 4 can be thinner than conventional sheet 110 shown in FIG. 4, accordingly preventing base sheet 4 from affecting the reversing of the shapes of movable contacts 8 and 208. Light guide sheet 3 needs to have a predetermined thickness in order to allow light to transmit therein. As shown in FIGS. 2 and 3, light guide sheet 3 has a flat shape or a shape sagging gently. This configuration allows light to easily transmit inside light guide sheet 3, hence allowing light guide sheet 3 to be thin. The pressing forces are applied to movable contacts 8 and 208 via columnar portions 6 and 206 located away from outer edges 8C and 208C, respectively, and are efficiently transmitted to the centers of movable contacts 8 and 208, hence reversing the shapes of movable contacts 8 and 208 easily. Columnar portions 6 and 206 contact light guide sheet 3 and base sheet 4 even while keys 1 and 201 are not depressed, an operator feels reaction force via a finger simultaneously upon having the finger pressing of keys 1 and 201. Hence, the operator can activate switch 1001 with a preferable operation feeling. Columnar portion 6 and 206 are located at the center of movable contacts 8 and 208 away from outer edges 8C and 208C of movable contacts 8 and 208, respectively. This structure allows central portions of upper surfaces 8A and 208A of movable contacts 8 and 208 to be pressed, but prevents outer edges 8C and 208C from being pressed. Hence, even if the centers of keys 1 and 201 are slightly misaligned from the centers of movable contacts 8 and 208, the operator can activate switch 1001 with a preferable feeling.

Columnar portions 6 and 206, light guide sheet 3, and base sheet 4 may be made of resin material unitarily with each other to constitute a module. This structure stably positions columnar portions 6 and 206, light guide sheet 3, and base sheet 4. Columnar portions 6 and 206 may not necessarily be bonded to both of light guide sheet 3 and base sheet 4, but may preferably be bonded to base sheet 4.

A functional layer for preventing leakage of light from light guide sheet 3 may be provided on lower surface 3B of light guide sheet 3. This layer allows strong light to be emitted from upper surface 3A, accordingly illuminating keys 1 and 201 located above upper surface 3A of light guide sheet 3 brightly.

In switch 1001, movable switch 8 (208) and fixed contacts 10A and 10B (210A and 210B) constitute switch contact section. The switch contact section of the switch in accordance with the embodiment is not limited to this. A switch contact section that operates covered with base sheet 4 provides the same effects.

What is claimed is:

1. A movable contact assembly comprising:

a movable contact having a dome shape having an upper surface and a lower surface, the upper surface of the movable contact being convex, the lower surface of the movable contact being concave, the movable contact having an outer edge;

a base sheet made of insulating material, the base sheet including:

a dome portion having an upper surface and a lower surface, the lower surface of the dome portion being concave along the upper surface of the movable contact, the lower surface of the dome portion being situated on the upper surface of the movable contact, the dome portion having an outer edge, a flat portion connected with the outer edge of the dome portion and having a lower surface being flat and which is continuous with said lower surface of said dome portion and an upper surface which is continuous with said upper surface of said dome portion; and a board provided on said lower surface of said flat portion of said base sheet without a space therebetween;

a columnar portion having an upper surface and a lower surface, the lower surface of the columnar portion being situated on the upper surface of the dome portion away from the outer edge of the dome portion of the base sheet; and a light guide sheet having an upper surface and a lower surface, the lower surface of the light guide sheet contacting the upper surface of the columnar portion, wherein the light guide sheet has a light-receiving surface along an edge of said light guide sheet for introducing light into the light guide sheet, and allows the introduced light to be emitted from the upper surface of the light guide sheet.

2. The movable contact assembly of claim 1, wherein a portion of the light guide sheet directly above the first dome portion of the base sheet is flat.

3. The movable contact assembly of claim 1, wherein the lower surface of the columnar portion is adhered to the upper surface of the dome portion of the base sheet.

4. The movable contact assembly of claim 1, wherein said columnar portion does not emit light.

5. The movable contact assembly of claim 1, wherein said columnar portion prevents said light guide sheet from contacting said dome portion of said base sheet.

6. A switch comprising:

a first movable contact having a dome shape having an upper surface and a lower surface, the upper surface of the first movable contact being convex, the lower surface of the first movable contact being concave, the first movable contact having an outer edge;

a base sheet made of insulating material, the base sheet including a first dome portion having an upper surface and a lower surface, the lower surface of the first dome portion being concave along the upper surface of the first movable contact, the lower surface of the first dome portion being situated on the upper surface of the first movable contact, the first dome portion having an outer edge, a flat portion connected with the outer edge of the first dome portion and having a lower surface being flat and which is continuous with said lower surface of said dome portion and an upper surface which is continuous with said upper surface of said dome portion; and a board situated on said lower surface of said flat portion of said base sheet without a space therebetween;

a first columnar portion having an upper surface and a lower surface, the lower surface of the first columnar portion being situated on the upper surface of the first dome portion away from the outer edge of the first dome portion of the base sheet;

a light guide sheet having an upper surface and a lower surface, the lower surface of the light guide sheet contacting the upper surface of the first columnar portion; and a first fixed contact provided on the board, the first fixed contact facing the lower surface of the first movable contact by a gap, wherein the light guide sheet has a light-receiving surface along an edge of said light guide sheet for introducing light into the light guide sheet, and allows the introduced light to be emitted from the upper surface of the light guide sheet.

7. The switch of claim 6, wherein a portion of the light guide sheet directly above the first domed portion of the base sheet is flat.

8. The switch of claim 6, wherein the lower surface of the first columnar portion is adhered to the upper surface of the first dome portion of the base sheet.

9. The switch of claim 6 further comprising:

a second movable contact having a dome shape having an upper surface and a lower surface, the upper surface of the second movable contact being convex, the lower surface of the second movable contact being concave, the second movable contact having an outer edge;

a second columnar portion provided between the light guide sheet and the base sheet;

a second fixed contact provided on the board, the second fixed contact facing the lower surface of the second movable contact by a gap, wherein the base sheet further includes a second dome portion having an upper surface and a lower surface, the lower surface of the second dome portion being concave along the upper surface of the second movable contact, the lower surface of the second dome portion being situated on the upper surface of the second movable contact, the second dome portion having an outer edge, the second columnar portion has an upper surface and a lower surface, the lower surface of the second columnar portion being situated on the upper surface of the second dome portion away from the outer edge of the second dome portion of the base sheet, and the lower surface of the light guide sheet contacts the upper surface of the second columnar portion.

10. The switch of claim 9, wherein a portion of the light guide sheet extending from a portion of the light guide sheet directly above the first dome portion of the base sheet to a portion of the light guide sheet directly above the second dome portion is flat.

11. The switch of claim 9, wherein the lower surface of the second columnar portion is adhered to the upper surface of the second dome portion of the base sheet.

12. The switch of claim 6, wherein said first columnar portion does not emit light.

13. The switch of claim 6, wherein said first columnar portion prevents said light guide sheet from contacting said dome portion of said base sheet.

* * * * *